United States Patent [19]

Achten et al.

[11] 4,325,197

[45] Apr. 20, 1982

[54] QUICK-ERECT PORTABLE DISPLAY STRUCTURE

[75] Inventors: David J. Achten, Oakdale; Robert W. Fritts, Afton, both of Minn.

[73] Assignee: Minnesota Mining & Manufacturing Company, St. Paul, Minn.

[21] Appl. No.: 230,548

[22] Filed: Feb. 2, 1981

[51] Int. Cl.[3] ..... G09F 15/00

[52] U.S. Cl. ..... 40/610; 40/606; 40/152.1; 40/155; 116/63 P

[58] Field of Search ..... 40/606, 607, 610, 152.1, 40/155; 116/63 P; 248/165; 52/760

[56] References Cited

U.S. PATENT DOCUMENTS

| | | | |
|---|---|---|---|
| 1,308,680 | 7/1919 | Price | 40/610 |
| 2,062,479 | 12/1936 | Ritz-Woller | 40/610 |
| 2,064,047 | 12/1936 | Wertz | 40/606 |
| 2,141,526 | 12/1938 | Foster | 40/606 |
| 2,798,451 | 7/1957 | Hund | 116/63 P |
| 3,098,611 | 7/1963 | Connell | 40/155 |
| 3,847,335 | 11/1974 | Ross | 40/610 |
| 3,978,631 | 9/1976 | Diersing | 40/152.1 |
| 4,144,664 | 3/1979 | De Korte | 40/152.1 |

OTHER PUBLICATIONS

"Da—Lite CPE Fast Fold:" A Catalog on Portable Projection Screens; from Da—Lite Screen Company, Inc. of Warsaw, Indiana 46580; 16 pp.

*Primary Examiner*—Gene Mancene
*Assistant Examiner*—Wenceslao J. Contreras
*Attorney, Agent, or Firm*—Cruzan Alexander; Donald M. Sell; John C. Barnes

[57] ABSTRACT

A display for the back wall of a tradeshow booth comprising a frame having four foldable corner members of tubular material, each with a pair of pivoted legs with each leg having one part of a two-part fastening tape adhered thereto and footings formed of tubular material for supporting the connected corner members in a vertical position.

4 Claims, 7 Drawing Figures

QUICK-ERECT PORTABLE DISPLAY STRUCTURE

DESCRIPTION

1. Technical Field

This invention relates to an improved frame for supporting a mural on a flexible backing and particularly to a portable display structure for supporting such a mural as a display backwall for a tradeshow booth.

2. Background Art

The tradeshow industry requires that various exhibitors erect a show booth at one or more tradeshows throughout the world every year and perhaps more often. The tradeshow provides an opportunity for a company, large and small, to sell products and/or services and to contact potential customers for one-half to one-third the cost of making sales calls to potential customers at their home offices. The tradeshows are an integral part of conventions, national and regional meetings of professional groups, trade associations and the like.

Each exhibitor at any tradeshow must set up the show booth in the exhibition hall. The exhibit and all of its parts and pieces must survive shipment into the exhibition hall to be set up in mint condition, generally by someone unfamilar with the display. From 5% to 8% of all exhibits are damaged during shipment and require onsite repair. For conventional display booths, the dead weight of the protective boxes or crates often exceeds the weight of the exhibit itself. All such protective shipping containers are emptied at set-up time, hustled off to a storage area during the show, and are recalled to repack and ship out the display after the show. Most of this activity is done by union labor and the cost of such operation is very high.

The time for setting up the average tradeshow booth is 4 hours with two men. Approximately 3 hours are required to disassemble the booth and recrate the parts. These tradeshow booths generally include a rigid frame which supports the backwall for the booth. This frame may include supports for various lighting concepts and for rigid art work displayed on the backwall. Alternatively, the primary part of the backwall may be a projection screen or similar support for graphics. Numerous pieces of preformed plastic and panels are joined to form the booth.

The frame of the present invention permits the booth to be erected and the graphics to be adhered to the frame by a single individual in a minimum amount of time. Additional tables or other support areas may be then readily positioned in front of the back drop and covered with a cloth and/or drape. The booth would then be complete and ready for use.

Prior art which may be pertinent to the present invention includes readily erectable projection screens used in auditoriums for receiving movie, slide or overhead projections. Some portable large screens having sizes of 15 feet by 20 feet are available. One company having such screens is Da-Lite Screen Company, Inc., Warsaw, Indiana 46580. An example of their erectable screen is the Da-Lite CPE Fast-Fold Screen which is made of tubular stock with pivoted and locked-together parts with a screen face which is snapped to the edges of the frame. This frame does not have the capability for adjusting the position of the screen face to keep it taut with changes in temperature and humidity of the auditoriums, and the snap fasteners cause scallops to appear along the edge which are not attractive.

DISCLOSURE OF INVENTION

The present invention is directed toward a quick-erect portable display structure for use in tradeshows to support a mural for use as a back drop in a tradeshow booth. The display structure comprises 6 or 8 pieces, depending on the size of the frame desired. The frame generally comprises four foldable corner members, each having a pair of legs pivotally connected at one end to be pivoted from a folded condition with the legs parallel to a position with the legs perpendicular to one another and including a locking toggle brace. The legs are formed of hollow metal tubular one inch stock and at least one leg of each corner has an extended end portion adapted to be received within the hollow portion of another leg member or extension member and spaced holes are formed on said end portion. A pair of tubular members afford the extensions for the top and bottom edges of the frame structure. Foot support members comprise lengths of tubular material having a pin disposed intermediate the ends thereof which pins are cylindrical and adapted to be received in one leg of two corner members adjacent the hinge, and it has a brace member pivotally connected at one end and adapted to be connected by a pin to one leg of the adjacent corner member to hold the leg vertically.

One face of each corner member and the extension members are preferably covered by one part of a two-part fastening tape which one part is adhered thereto as by a pressure-sensitive adhesive with a peel strength exceeding that of the fastening tape. The fastening tape may be the one portion of a hook and loop fastening tape. A mural with the desired art work of rectangular shape is adapted to be suspended on the frame. The art work is on a flexible material such as canvas having the other part of the fastening tape adhered thereto as by sewing or a suitable pressure-sensitive or hot melt adhesive. The fastening tape allows for a tightening of the material such that it may be pulled to a taut condition about the perimeter thereof on the display structure.

BRIEF DESCRIPTION OF THE DRAWINGS

The present invention will be described in greater detail hereinafter with reference to the accompanying drawings wherein.

BEST MODE FOR CARRYING OUT THE INVENTION

The quick-erect frame structure of this invention is particularly adapted for use in supporting a backdrop at a tradeshow booth. A backdrop which is 8 feet by 10 feet bearing a color image on a flexible fabric together with the supporting frame is adapted to fit in a sturdy carrying case which is five inches by 10 inches by 52 inches. This means that the major portion of a tradeshow booth could be checked onto the airplane with the personnel going to the tradeshow and could be easily carried into the tradeshow and erected on site.

Figure 1:
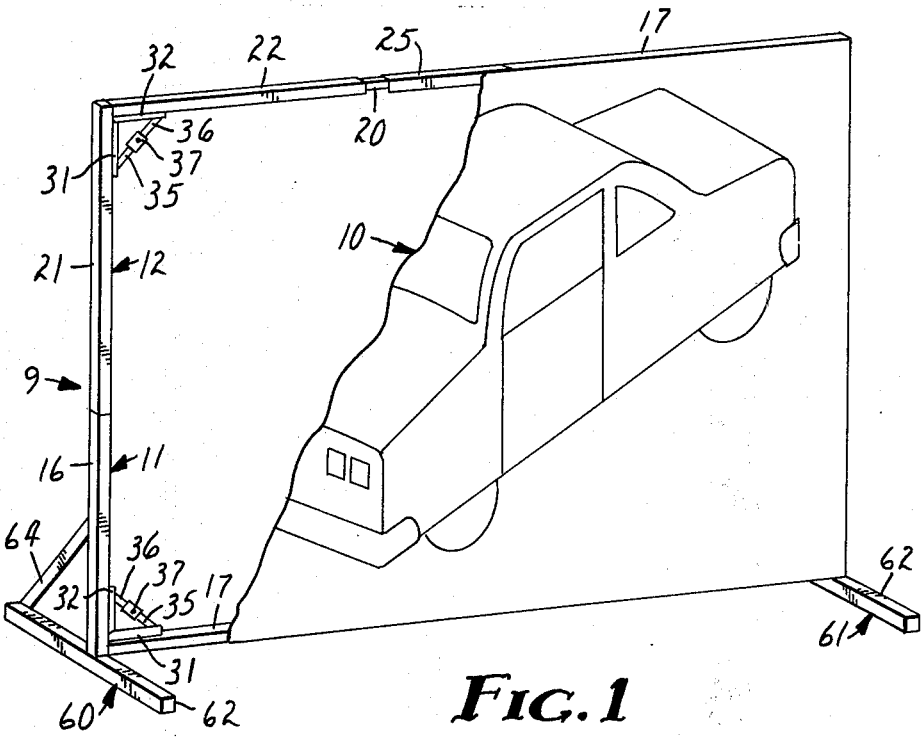
FIG. 1 is a perspective view of the display structure according to the present invention with mural adhered thereto, parts are broken away to show hidden parts.
Figure 2:
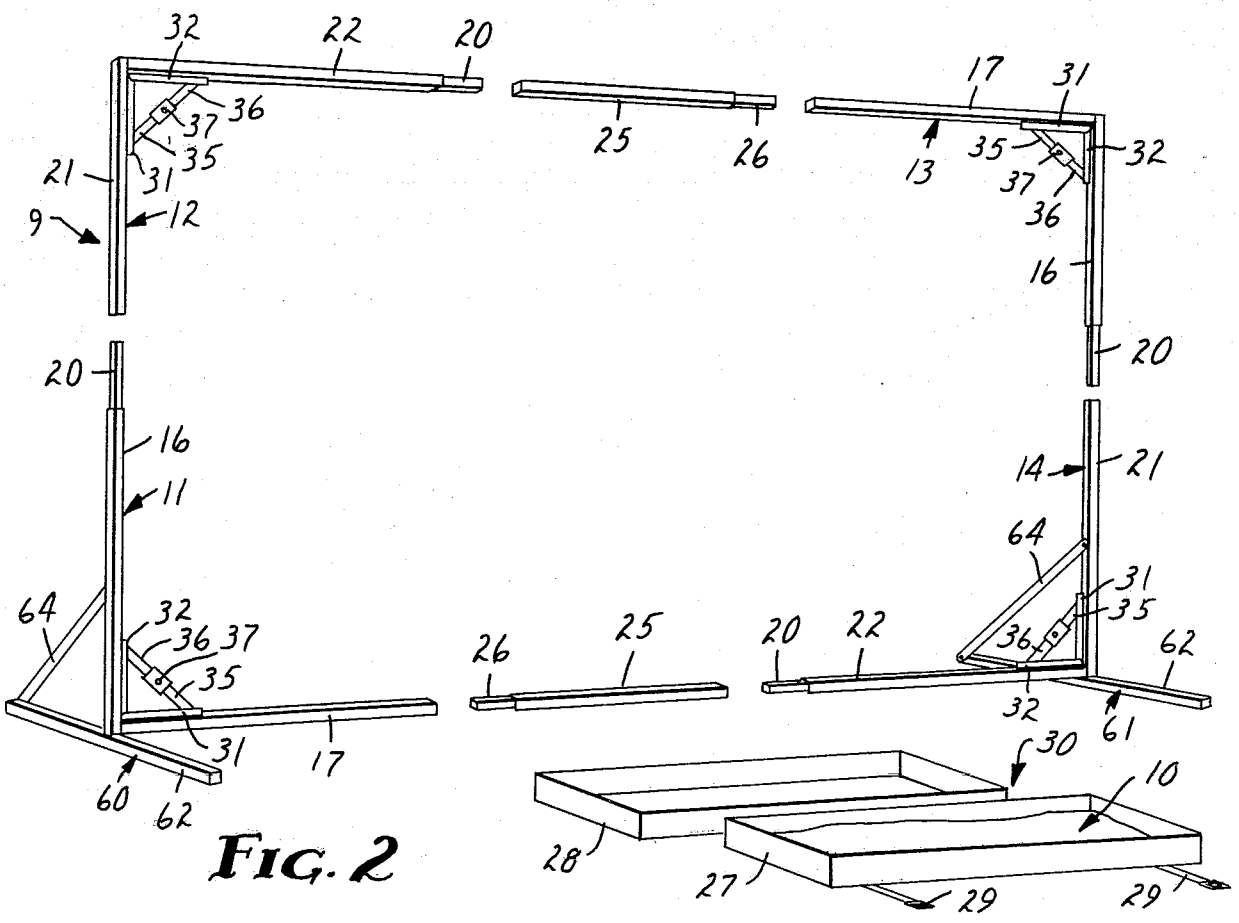
FIG. 2 is an exploded perspective view of the display structure kit.

The portable display structure as illustrated in FIG. 1 provides a vertical frame 9 which may have a height of between 93 and 96 inches and a width of between 84 to 87 or 116 to 122 inches. On this frame 9 is suspended in taut condition a four-color mural 10 which affords the graphics for the tradeshow booth. The frame as more specifically illustrated in FIG. 2 comprises four folded corner members 11, 12, 13, and 14. The corner members 11 and 13, and the corner members 12 and 14 are identical, and all the corner members are similar to one another except for the length of the legs. In a preferred construction the corner members 11 and 13 have a leg 16 which is 43 inches long and a leg 17 which is 41 inches long. Corner members 12 and 14 each have a leg 21 which is 50 inches long, and a leg 22 which is 41 inches long.

Each of the corner members 11, 12, 13 and 14 have a telescoping, projecting end portion 20 which slides into the open end portion of the tubular member of an adjacent frame member to fit the pieces together.

A pair of tubular extension members 25 which are 32 inches long and are each provided with a 6 inch telescoping end section 26 provide a means for extending the frame, which would normally be from 84 inches to 87 inches wide, to a frame which has a width of between 116 inches and 122 inches. The eight frame pieces and the mural 10 all fit in a two part sturdy telescoping carrying case 30 having a bottom 27, a top 28 and fastening straps 29.

Figure 3:
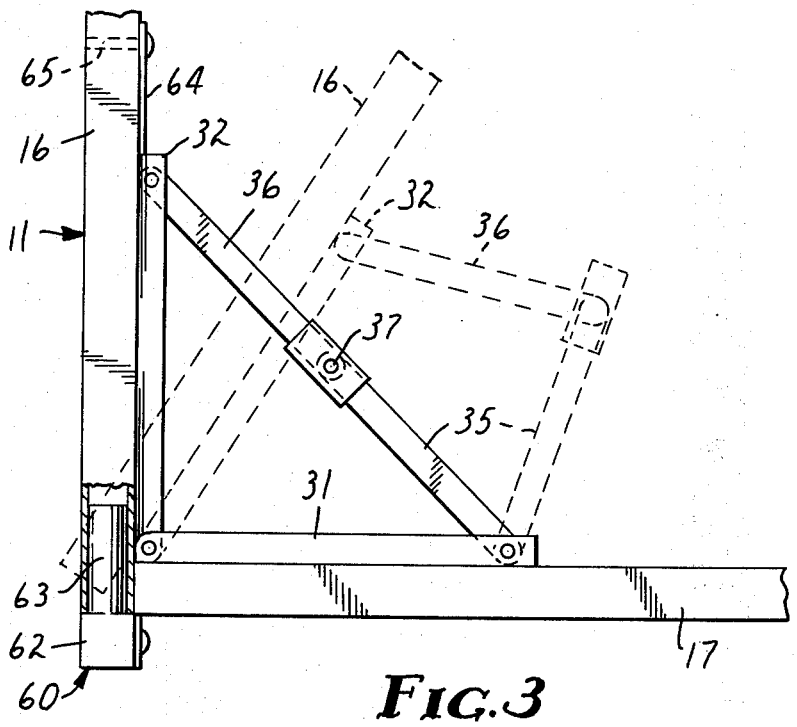
FIG. 3 is a detailed partial sectional view of the corner member and footing.
Figure 4:
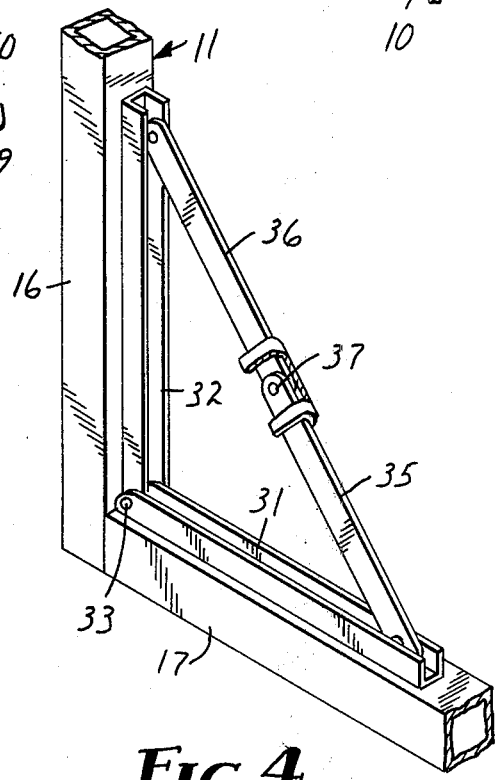
FIG. 4 is a detailed perspective view of the corner in the unfolded position.

To describe one collapsible corner member in greater detail, attention is now directed to FIGS. 3 and 4 which illustrate the corner member 11 having legs 16 and 17 formed of rectangular tubular material which preferably is one inch square extruded aluminum tubing having a 1/16 inch wall thickness. The legs 16 and 17 are pivotally connected together at one end to be movable between a folded parallel position to a position with the legs perpendicular to each other, with the end of one of the legs 16 opening downwardly. Secured to each leg as by pop rivets are a pair of channel members 31 and 32 which are joined together at adjacent ends by means of a pivot pin 33 extending through the channels and forming the pivot axis for the corner member 11. Pivotally connected to the channel members 31 and 32 is a toggle linkage comprising the links 35 and 36 which are pivoted together by a pin 37 and pivotally connected to the channel 31 and 32 respectively by rivet pins. The toggle linkage provides a collapsible gusset to hold the legs 16 and 17 in their unfolded perpendicular position. Each of the corner members 12, 13 and 14 have similar channel members and collapsible toggle linkages and will not be described in detail.

Figure 5:
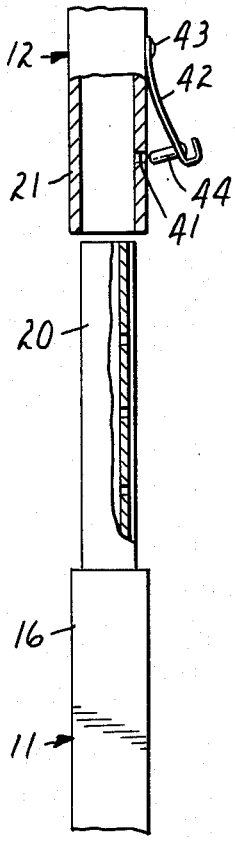
FIG. 5 is a detailed view of the latching system for the vertical legs of the corner members.

At least one leg of each corner member is provided with a projecting end portion 20 which telescopes into an adjacent end portion of an adjacent frame member. These end portions 20 are formed of hollow tubular steel which has an outside dimension of roughly $\frac{7}{8}$ by $\frac{7}{8}$ inch. The projecting members have been bent longitudinally along each side to slightly crimp the sidewalls, thus further reducing the exterior dimension of the extended end portions 20 such that the same more readily slide into the tubular legs of the frame members. Each projecting end portion 20 is secured to a leg member or the extension member 25 by means of a rivet. The outwardly extending portion is provided with spaced holes 40 which are preferably one inch apart. As illustrated in FIG. 5 the extension 20 on leg 17 slides into the open end of leg 21 of corner member 12. At least one leg, as illustrated for leg 21 of corner member 12, is provided with an opening 41 in the wall member, and has a leaf spring member 42 which is attached at one end to the leg 21 by a rivet 43 and has a locking pin 44 connected to the other end thereof and positioned for movement into and out of the opening 41. When the projecting end portion 20 is inserted in the end of leg 21 the relative position of the two legs may be selected and then the pin 44 is allowed to penetrate the opening 41 and one of the holes 40 to secure the legs in the desired position.

Figure 6:
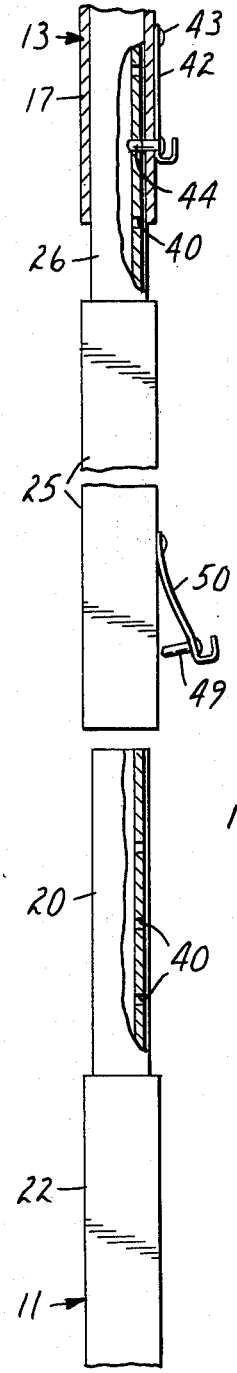
FIG. 6 is a detailed broken view of the latching structure for the horizontal legs of the structure and the extensions.

As illustrated in FIG. 6 similar locking pins 49 are provided at one end of the extension 25 which are supported on a leaf spring 50, and the projecting end portion 20 of extension 25 fits in the open end of leg 17 of corner member 13 and is locked in place by a pin 44, as illustrated in the upper portion of FIG. 6. The holes 40, in the projecting end portions 20 and 26 provide for adjustment of the size of the frame to that desired between the limits recited above.

Figure 7:
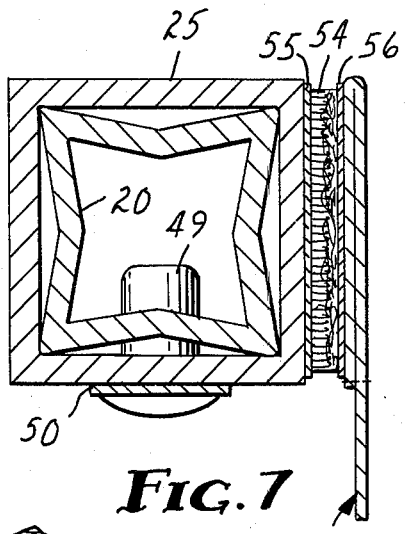
FIG. 7 is a detailed sectional view of the frame showing the mural and the fastening tape for the mural to the display structure.

Referring now to FIG. 7, there is illustrated in cross-section a tubular member of the frame 9 with the projecting end portion 20 received in the tubular member such as extension 25. The shape of the steel telescoping end portion 20 is best illustrated in this figure.

On the outer planar surface of the legs of the corner members 11, 12, 13, and 14, and of the extensions 25 is one part of a two-part fastening tape such as a hook and loop fastening tape illustrated in U.S. Pat. No. 3,009,235, issued to G. Mestral on Nov. 21, 1961. This two-part fastening tape is very suitable for securing the mural 10 to the frame 9 about its periphery. As illustrated in FIG. 7 one part 54 of the hook and loop fastening tape is adhered by a suitable adhesive 55 to the wall of the extension 25 and the second part 56 of the fastening tape is adhered to the periphery of the mural 10. The part 56 of the fastening tape is preferably adhered to the hem of the mural by sewing. On the legs of the corner members the part 54 of the fastening tape is adhered to a planar surface of the legs which is perpendicular to the axis of the hinge pin 33.

The display frame is maintained in an upright position by footings 60 and 61. These footings are positioned such that no braces are extending into the booth and comprise an elongate straight tubular steel member 62 which has projecting from a position intermediate its ends, preferably at the center, a circular stud 63 which has a diameter of approximately $\frac{7}{8}$ inch to be slidably received in the open end of the legs 16 and 21 respectively. The circular pins 63 position the footing 60 or 61, and a brace 64 comprising a link of steel 1 inch by $\frac{1}{8}$ inch is bolted to one end of the tubular member 62 and can be pivoted from a position parallel with the tubular member 62 to an inclined position. The opposite end of the link 64 is provided with a pin 65 which is hot-welded to the link 64 and which pin 65 fits through suitable openings in the legs 16 and 21 to support the legs in the vertical position from the tubular members 62.

In erecting the display structure 9 of the present invention the six pieces of the frame may be laid on the floor with the part 54 of the fastening tape facing up. The legs of the corner members are all positioned such that the projecting end portions 20 and 26 are all extending from the legs in a clockwise position about the frame. The end portions are then inserted in the adjacent frame member, and are locked in the desired position. The studs 63 from the footings are then inserted in the bottoms of the legs 11 and 21 with the tubular members 62 lying parallel with the legs 17 and 22. The frame is then raised to a vertical position onto the tubular members 62, and then the members 62 are rotated to a position perpendicular to the legs 17 and 22, and the brace links 64 are pivoted upward and urged outwardly such that the pins 65 on each link 64 may be inserted in the appropriate holes to maintain the structure vertically.

After the frame has been placed in the erected position the mural 10 may be applied. The mural is taken from the case 30 and unfolded and mounted onto the frame by starting to adhere the part 56 of the fastening tape to the part 54 at an upper corner and then across the upper legs 17 or 22 and across the extension 25. Next, a vertical edge is attached from top to bottom, then the other edge, and then the bottom edge is attached. The material is stretched slightly and then the tape is fastened together.

Thus, the backdrop of the entire tradeshow booth comprises eight pieces, none of which exceed 51 inches in length and none of which are small enough such that they could become lost or put in someone's pocket and not retained with the display.

Having thus described the present invention with respect to a preferred embodiment, it is to be understood that the scope of the present invention may vary as recited in the appended claims.

We claim:

1. A quick-erect portable display structure adapted to support a rectangular mural on a flexible fabric material, said structure comprising four similar collapsible corner members each comprising a pair of hollow tubular legs pivotally connected adjacent one end and movable about an axis between a folded parallel position and a perpendicular position and each having a locking toggle to form a gusset between said legs, at least one leg of each member being formed with a projecting end portion adapted to fit in a hollow end of an adjacent tubular member and having a plurality of spaced holes affording an adjustable locked position between said end portion and said adjacent member;

a strip of fastening tape adhered to a face of each leg of said corner members which face is disposed perpendicular to the axis of said pivotal connection;

a pair of footings each formed of rigid straight tubular material of a predetermined length, each footing having a pin extending perpendicular thereto intermediate its ends for receiving one leg of a said corner member and having a brace extending from an end thereof adapted to connect with said one leg of said corner member for maintaining said structure in an upright position.

2. A portable display structure according to claim 1 wherein a tubular straight extension member is 1ositioned between adjacent legs of two of said corner members for increasing the dimension of said display structure by the length of said extension.

3. A portable display structure according to claim 1 wherein said end portions and the adjacent tubular member has a pin fitting through an opening in said tubular member and into one of said holes in an end portion to retain the same in said adjusted position.

4. A kit from which to form a large rectangular display structure adapted to support a rectangular mural on a flexible backing, said kit comprising four corner members, pairs of which are identical, each corner member comprising a pair of hollow tubular legs pivotally connected at one end and movable between a folded parallel position and a perrpendicular position, a pivoted locking toggle connected to said legs to form a gusset between said legs adjacent said pivot connection, and at least one leg of each corner member being formed with a projecting end portion having spaced holes therethrough and the opposite leg being provided with a pin extending through said tubular leg to receive an end portion.

a pair of tubular hollow straight extensions each having a projecting end portion for connection between adjacent corner members, a strip of fastening tape applied to an outer planar surface of each leg with the tape on a surface perpendicular to the axis of said pivotal connection, a pair of footings formed of rigid straight tubular material of a predetermined length, each footing having a pin extending perpendicular thereto intermediate its ends and adapted for insertion in one leg of a said corner member, and a brace pivotally connected to one end of each footing and having a length to extend therefrom to connect to said one leg of a said corner member above the toggle for holding said corner member with said one leg in a vertical position, a flexible fabric having a cooperating strip of fastening tape adhered thereto, and a sturdy carrying case to receive the four collapsible corner members, the pair of straight extension members, the pair of footings, and the folded fabric for transporting as an integral complete system.

* * * * *